United States Patent [19]

Connolly

[11] Patent Number: 4,848,432

[45] Date of Patent: Jul. 18, 1989

[54] MOUNTING BRACKET FOR VENETIAN BLINDS

[75] Inventor: Peter F. Connolly, Parsippany, N.J.

[73] Assignee: Jencraft Corporation, Totowa, N.J.

[21] Appl. No.: 229,305

[22] Filed: Aug. 8, 1988

[51] Int. Cl.[4] ..... E06B 9/38

[52] U.S. Cl. ..... 160/178.1; 160/181; 160/902; 248/264; 403/44

[58] Field of Search ..... 160/21, 39, 166.1, 168.1, 160/178.1, 181, 902; 211/105.4; 248/57, 257, 264, 268, 269; 403/43, 44, 45, 47, 118

[56] References Cited

U.S. PATENT DOCUMENTS

| | | | |
|---|---|---|---|
| 252,023 | 1/1882 | Farley | 160/298 |
| 1,112,950 | 10/1914 | Vaughan | 403/118 |
| 1,299,556 | 4/1919 | Creclius | 211/105.3 |
| 1,823,236 | 9/1930 | Burns | 160/171 |
| 2,151,223 | 3/1939 | Nayman, Sr. | 211/105.4 |
| 2,181,101 | 11/1939 | Spenard | 160/349.1 |
| 2,199,851 | 5/1940 | Culver | 248/264 |
| 2,423,978 | 7/1947 | Hunter | 160/178.1 |
| 2,474,434 | 6/1949 | Mentz | 211/105.4 X |
| 2,787,322 | 4/1957 | Jacobson et al. | 160/178.1 X |
| 2,870,918 | 1/1959 | Grubbs | 248/265 X |
| 2,888,226 | 5/1959 | Androit et al. | 248/251 |
| 2,941,591 | 6/1960 | Meyer | 160/126 X |
| 3,260,257 | 7/1966 | Mason | 160/21 X |
| 3,580,397 | 5/1971 | Triplett | 211/105.4 |
| 3,762,459 | 10/1973 | Stuart | 160/39 X |
| 3,948,475 | 4/1976 | Jones | 248/231.2 |
| 4,381,578 | 5/1983 | Glejf | 248/264 X |
| 4,457,117 | 7/1984 | Leiher et al. | 403/44 X |
| 4,782,882 | 11/1988 | Amedeo et al. | 160/178.1 |

FOREIGN PATENT DOCUMENTS

| | | |
|---|---|---|
| 540459 | 3/1956 | Italy . |
| 7761 | of 1903 | United Kingdom . |

*Primary Examiner*—Ramon S. Britts
*Assistant Examiner*—David G. Kolman
*Attorney, Agent, or Firm*—Lerner, David, Littenberg, Krumholz & Mentlik

[57] ABSTRACT

A universal mounting bracket is provided for one or both ends of the head rail of a venetian blind or other such article, for example, a curtain rod, fireplace screen, drapery rod, or the like. The mounting bracket is operative for securing the aforementioned articles either within or across the opening of a window frame by compression fit without the necessity of nails and screws or other such items which would permanently injure the window casing. The mounting bracket may be easily installed or removed in order to accommodate simple installation of an article, its realignment or removal for repair or replacement and the like.

17 Claims, 6 Drawing Sheets

FIG. 7
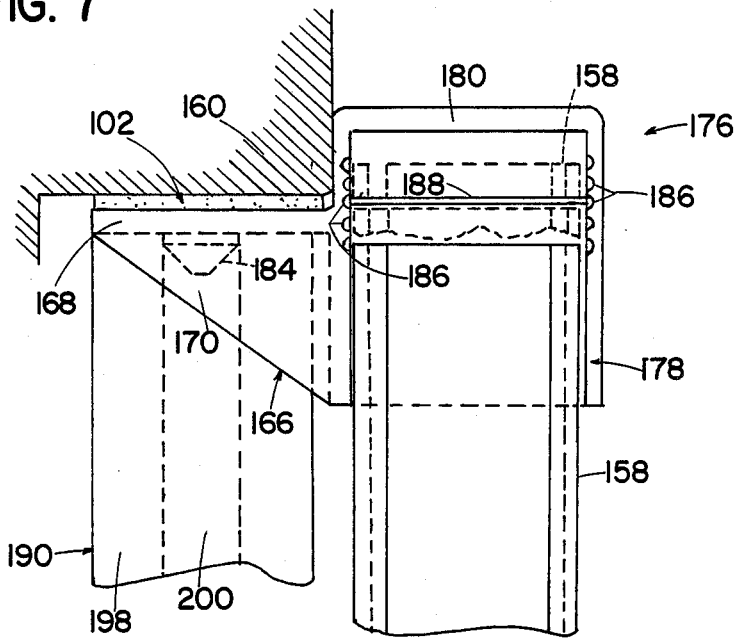
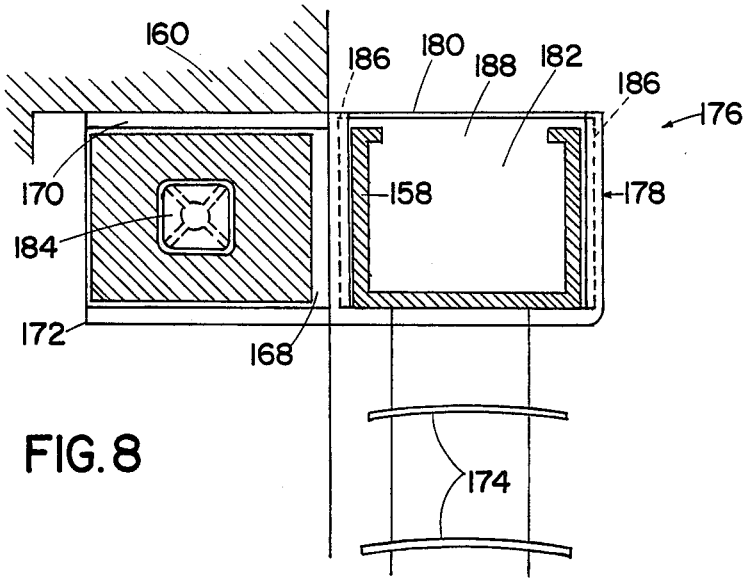
FIG. 8

MOUNTING BRACKET FOR VENETIAN BLINDS

BACKGROUND OF THE INVENTION

The present invention relates in general to a mounting bracket adapted for supporting an article within or across the expanse of an opening such as a window frame, and more particularly, to such a mounting bracket adapted for mounting various articles such as venetian blinds, curtain rods, fireplace screens, drapery rods and the like without the need for hardware such as bolts, screws, nails or the like which would otherwise permanently damage the window frame.

Venetian blinds are typically supported by a head rail that contains the mechanisms that support the strings that control the movement of the individual slats of the blind. Mounting brackets are usually provided on either end of the head rail to be attached to the top of a window casement, either on the inside or the outside thereof. These mounting brackets are usually open brackets that must be permanently fastened to the window casement, but can be opened to permit the head rail to be mounted, or removed at any time for cleaning or adjustment if necessary. Two such known mounting brackets are disclosed in Hunter, U.S. Pat. No. 2,423,978 and Burns, U.S. Pat. No. 1,823,236.

In many cases, where the casements are deep enough, and for aesthetic considerations, these mounting brackets are fitted inside the casements so that the venetian blinds do not extend out into the room, or interfere with curtains or drapes that may be planned for the window openings. In any event, these mounting brackets must be physically secured to the window casement, with screws or other such fasteners that inevitably puncture the casement, and leave permanent scars, however trivial. If the alignment is not initially perfect, additional holes must be drilled to get the individual slats of the blinds to hang properly. All of this takes time and skill for mounting and for the correct alignment of the brackets, which is not necessarily within the capability of the average home owner or head of the household, male or female.

In an apparent attempt to overcome some of the foregoing disadvantages of the known mounting brackets, there have been devised a number of mounting devices. For example, a telescoping pole and set screw is known from Crecelius, U.S. Pat. No. 1,299,556, a spring loaded extendable rod is known from Spenard, U.S. Pat. No. 2,181,101 Grubbs, U.S. Pat. No. 2,870,918, Androit, U.S. Pat. No. 2,888,226, and Culver, U.S. Pat. No. 2,199,851, friction fit between a pair of resilient pads is known from Filey, U.S. Pat. No. 252,023 and Italian Pat. No. 540,459, and a turnbuckle mechanism is known from Meyer, U.S. Pat. No. 2,941,591.

These known mounting devices, although useful for their intended purpose, are somewhat crude in nature. To this end, there is further known a mounting bracket which is not required to be permanently screwed or fastened to the lintel or jambs of a window frame to support a venetian blind. This mounting bracket is constructed to fit over one or both ends of the head rail of a venetian blind and to fit within the window frame. The mounting bracket is pressed against the window frame jambs, by leverage, tightly enough to hold the venetian blind in place. Leverage is achieved by a cam arranged within the mounting bracket and rotatable by an externally extending easily rotated lever so as to mount or dismount the venetian blind or to adjust the angle thereof with respect to the window frame jambs. The mounting bracket is provided with one or more spacers to compensate for minor differences in the distance between the inside of the frames of a given window casement. Although this mounting bracket is a refinement over the aforementioned mounting devices, there is still the need for improvements in simplifying such devices in a manner which enhances its usability by the average home owner or head of a household.

SUMMARY OF THE INVENTION

It is one object of the present invention to provide a mounting bracket for mounting venetian blinds, curtain rods, fireplace screens, drapery rods and the like within or across a window frame or the like, and which can be fitted onto the ends of the article to be mounted for frictionally fastening the article within the window casement or other framed opening without screws or nails or other things that would physically change or damage the sides of the window casement or other such opening.

Another object of the present invention is to provide a mounting bracket that can be very quickly mounted with minimal skill, and which can be as easily and quickly dismounted for realignment, cleaning or replacement, if necessary.

Another object of the present invention is to provide a mounting bracket whose installation technique is within the capability of the average home owner or head of a household.

Another object of the present invention is to provide a mounting bracket that permits articles to be mounted in minutes, without drills or screws or careful measurements, while being removed or realigned or replaced as easily, without any damage to a window casement or other such opening.

In accordance with one embodiment of the present invention there is disclosed a device for mounting an article across an opening, the device is constructed of a first mounting bracket including a housing having a first portion constructed to receive one end of the article and a second portion constructed to engage one surface bounding the opening, and an adjustment member rotatably mounted within the housing adjacent the article, the adjustment member advancing along an axis of the housing towards the article upon rotation of the adjustment member to urge the second portion of the housing against one surface bounding the opening to hold the article thereat.

In accordance with another embodiment of the present invention there is disclosed a device for mounting an article across an opening, the device constructed of a first mounting bracket including a housing having a first portion constructed to receive one end of the article, a second portion constructed to engage a first surface bounding the opening and a third portion opposing the first portion, the second portion comprising a lateral extension arranged transverse to the longitudinal axis of the housing, the lateral extension being displaced longitudinally along the longitudinal axis of the housing with respect to the third portion, and an adjustment member arranged outside of the housing and longitudinally extendable between the second portion of the housing and a second surface bounding the opening, the adjustment member when longitudinally extended urging the second portion against the first surface bounding the opening to hold the article thereat.

BRIEF DESCRIPTION OF THE DRAWINGS

The above description, as well as further objects, features and advantages of the present invention, will be more fully understood with reference to the following detailed description of a presently preferred, but nonetheless illustrative, mounting bracket for venetian blinds in accordance with the present invention, when taken in conjunction with the accompanying drawings, wherein:

FIG. 7 is a top plan view, in partial cross-section, of a mounting bracket constructed in accordance with another embodiment of the present invention;

FIG. 8 is a side elevation view, in partial cross-section, of the mounting bracket shown in FIG. 7;

DETAILED DESCRIPTION

The present invention will be described with respect to its utility in mounting a venetian blind within a window frame or thereacross. However, it is to be understood that the mounting bracket of the present invention has equal utility in the installation of other such articles as fireplace screens, shower curtain rods, drapery rods and the like.

Figure 1:
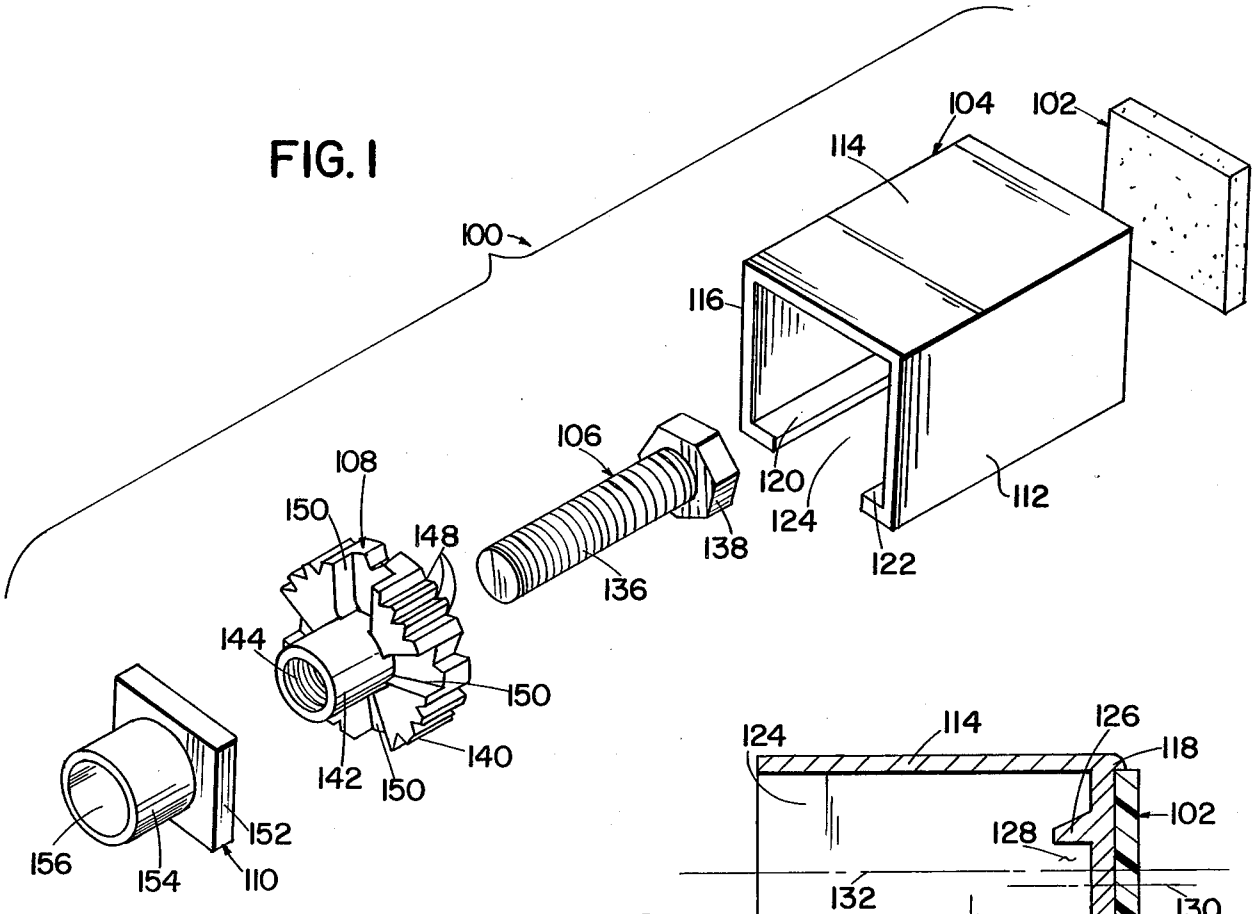
FIG. 1 is an exploded unassembled view of the components of a mounting bracket constructed in accordance with one embodiment of the present invention.

Referring now to the drawings, wherein like references numerals represent like elements, there is shown in FIG. 1 an unassembled exploded view of the components of a mounting bracket constructed in accordance with the present invention and generally designated by reference numeral 100. The mounting bracket 100 is generally constructed of a resilient pad 102, a housing 104, a threaded bolt 106, an adjustment member 108 and a spacer 110.

Figure 2:
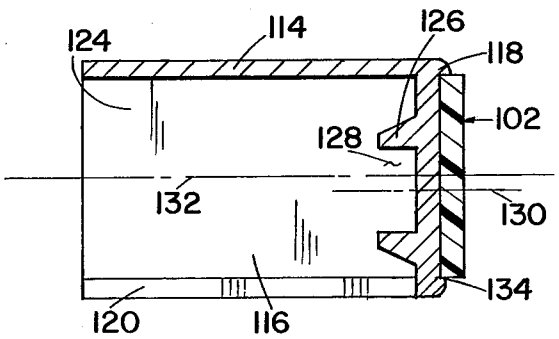
FIG. 2 is a cross-sectional view taken along line 2—2 of the housing component shown in FIG. 1.

The housing 104, as best shown in FIGS. 1 and 2, is constructed from side walls 112, 114, 116 arranged in a U-shape, an end wall 118 and a pair of flanges 120, 122 inwardly extending along the free edge of side walls 112, 116. The components of the housing 104 define an opening 124 having a generally rectangular profile. The inwardly facing surface of end wall 118 supports an annular shaped boss 126 defining an opening 128. The center line 130 of the opening 128 is laterally displaced from the center line 132 of the housing 104 for the purpose to be described hereinafter. The outwardly facing surface of end wall 118 is provided with a generally rectangular shaped recess 134 adapted to receive the resilient pad 102. The resilient pad 102 is formed of a resilient material such as natural rubber, polyurethane foam, and the like which will compress when forced tightly against a surface to conform therewith thereby improving the strength of mounting.

Figure 3:
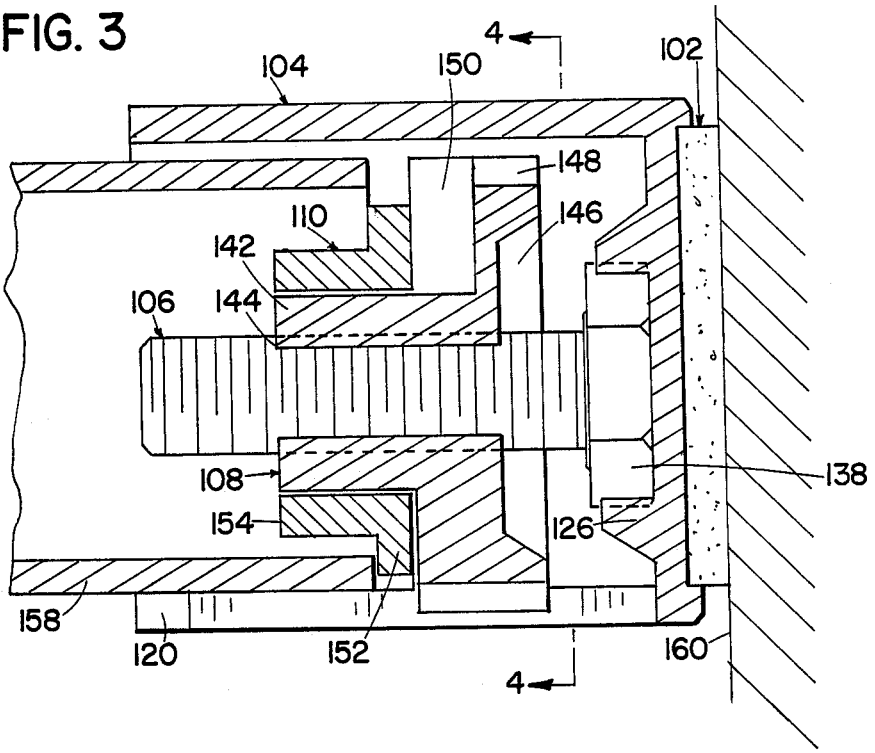
FIG. 3 is a cross-sectional view of an assembled mounting bracket in accordance with the embodiment shown in FIG. 1, illustrative of its application in mounting a venetian blind head rail within the opening of a window frame.

The bolt 106 may be of conventional construction including a plurality of threads 136 and a head 138. The head 138 may have a circular, hexagonal or other similar profile. In this regard, as shown in FIG. 3, opening 128 formed by boss 126 of the housing 104 is provided with a corresponding shape for receiving the bolt head 138. The bolt head 138 is secured within the opening 128 by being pressure fit or adhesively bonded so as to prevent rotation of the bolt 106 during use of the mounting bracket 100. As the housing 104 may be molded as a unitary structure, it is contemplated that the bolt 106 may likewise be unitarily formed with the housing 104.

The adjustment member 108, as best shown in FIGS. 1 and 3, is constructed of a cylindrical member 140 and a projecting cylindrical boss 142. A threaded bore 144 extends longitudinally through the cylindrical boss 142 and cylindrical member 140. The bore 144 is sized to threadingly receive the threaded portion of bolt 106. The surface of the cylindrical member 140 opposing the cylindrical boss 142 is provided with a recess 146 conforming in shape to the profile of the annular shaped boss 126 for the purpose to be described hereinafter. The peripheral edge of the cylindrical member 140 is provided with a plurality of V-shape cutouts 148. The surface of the cylindrical member 140 from which the cylindrical boss 142 extends is provided with a plurality of radially extending openings 150 extending from the peripheral edge of the cylindrical member to the cylindrical boss.

Figure 4:
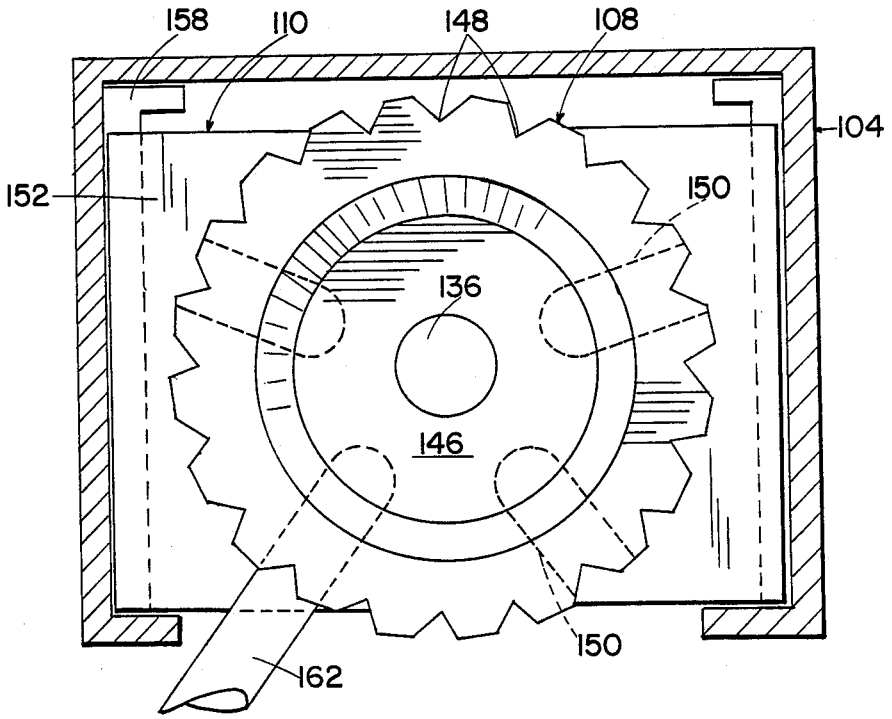
FIG. 4 is an end view, in partial cross-section, of the assembled mounting bracket shown in FIG. 3.

The spacer 110, as best shown in FIGS. 1 and 4, is constructed of a rectangular plate 150 from which there projects a cylindrical boss 154 having a smooth central bore 156. The central bore 156 is sized to receive in sliding engagement the cylindrical boss 142 of the adjustment member 108. The plate 152 is dimensioned to be slidingly received within the rectangular shaped opening 124 defined by the housing 104. It is contemplated that the adjustment member 108 and spacer 110 may be suitably formed by injection molding or the like from suitable plastics similar to the construction of housing 104. Alternatively, the housing 104, adjustment member 108 and spacer 110 may be formed from suitable metals, for example, diecast aluminum as desired. The bolt 106 may be formed from steel or similar materials compatible with the housing 104 when unitarily formed therewith.

The assembly of the components of the mounting bracket and its operation in mounting a venetian blind within the opening of a window frame will now be described. Referring to FIGS. 3 and 4, head 138 of bolt 106 is secured within opening 128 formed by the annular shaped boss 126 of the housing 104 as previously described. The adjustment member 108 is threadingly received upon the threaded portion of the bolt 106 within the opening 124 of the housing 104. The cylindrical boss 142 of the adjustment member 108 is arranged extending away from the end wall 118 of the housing 104 in order to receive the spacer 110. The spacer 110 is arranged having plate 152 abutting the cylindrical member 140 overlying a portion of openings 150 formed therein. The resilient pad 102 is secured within recess 134 within the end wall 118 of the housing 104. The mounting bracket 100, as thus far assembled, is ready for the installation of a venetian blind or other such article within the opening of a window frame.

With continued reference to FIGS. 3 and 4, the end of a head rail 158 of a venetian blind is received within the housing 104 having its end abutting against plate 152 of spacer 110. As more clearly shown in FIG. 4, plate 152 is dimensioned to be slidingly received within housing 104 while, at the same time, engaging the side walls and bottom wall of the head rail 158. The head rail 158 is positioned within the opening of a window frame with resilient pad 102 contacting frame member 160 defining the window casement. Initially, the adjustment member 108 may be positioned to the extreme right as viewed in FIG. 3 whereby the annular shaped boss 126 is received within the recess 146 provided in the adjustment member. This allows the head rail 158 to be received to the fullest extent possible within the housing 104 thereby minimizing the overall length of the coupled head rail and mounting bracket 100 to facilitate arrangement within the window opening.

As previously described, the center line 130 of opening 128 which receives the head 138 of bolt 106 is laterally off center from the center line 132 of the housing 104. As a result of this arrangement, the peripheral edge and V-shape cutouts 148 of the adjustment member 108 are positioned in a plane containing the flanges 120,122 of the housing 104. The adjustment member 108 may be easily rotated by extending ones fingers between the flanges 120,122 and engaging the V-shape cutouts 148 about the periphery thereof. The rotation of the adjustment member 108 in a clockwise direction, as viewed in FIG. 4, will cause the adjustment member and spacer 110 to be displaced longitudinally to the left, as viewed in FIG. 3, along center line 130. The advancement of the adjustment member 108 about bolt 106 urges spacer 110 against the end of the head rail 158 to force the housing 104 away from the head rail and into contact with the window frame member 160.

As the opposite end of the head rail 158 is positioned to engage an opposing frame member 160, further rotation of the adjustment member 108 will affect securing of the head rail 158 between the frame members 160 by compression. In order to achieve a sufficient compressive force, it may be required to rotate the adjustment member 108 to an extent greater than possible using ones fingers. To this end, an implement 162 such as a screw driver or the like is positioned extending through the opening between flanges 120,122 of the housing 104 and into one of the openings 150 within the adjustment member 108. As shown in FIG. 4, the implement 162 is rotated about bolt 106 in a clockwise direction to affect further compressive force in tightening the mounting bracket 100, or in a counter-clockwise direction to lessen the compressive force to allow removal of the mounting bracket and the venetian blind for adjustment, repair or cleaning.

In accordance with the application of the mounting bracket 100, as thus far described, the free end of the head rail 158 is abutted against the frame member 160, while the other end is received within the housing 104. Although such an installation of the head rail 158 is contemplated, it is preferred that a second mounting bracket 100 be provided on the opposing end of the head rail 158. In this regard, the head rail 158 will have a mounting bracket 100 on either end of identical construction. The adjustment member 108 of each of the mounting brackets 100 may be rotated independently to achieve the maximum outward compression for securing the head rail 158 between the frame members 160 of a window opening.

Figure 5:
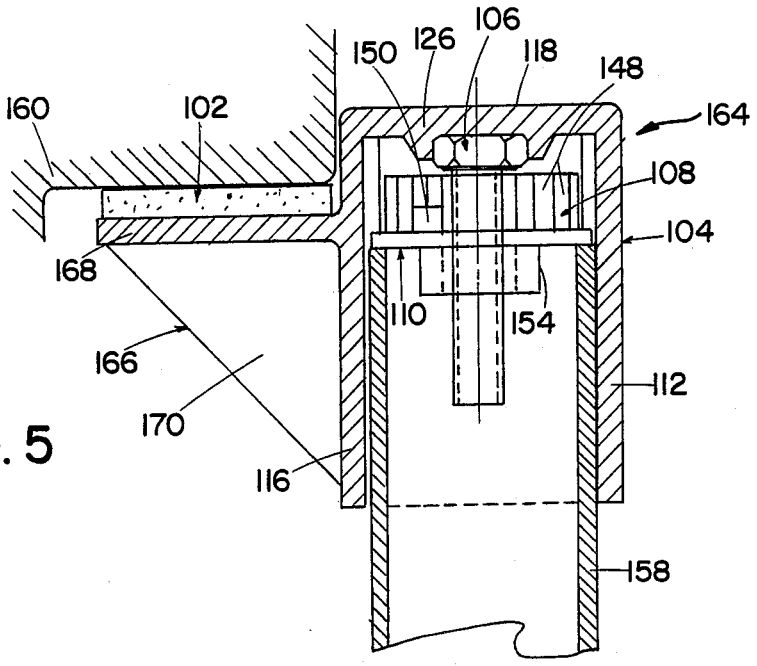
FIG. 5 is a top plan view, in partial cross-section, showing a mounting bracket constructed in accordance with another embodiment of the present invention.
Figure 6:
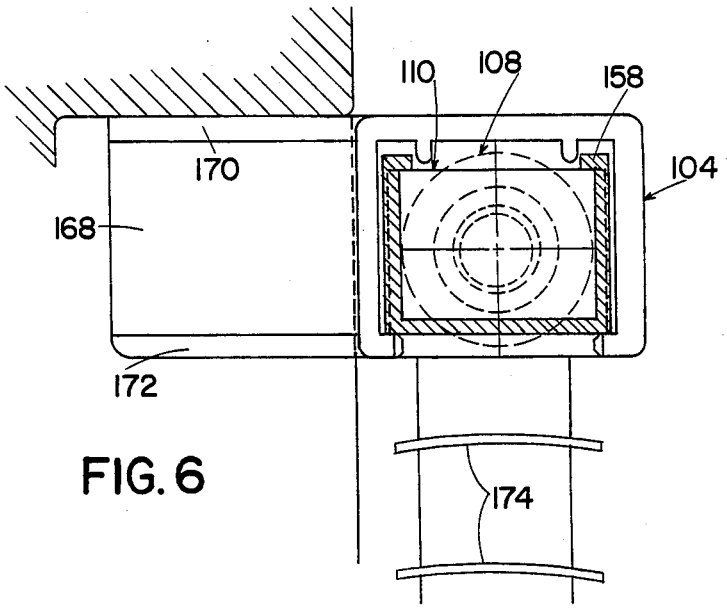
FIG. 6 is a side elevational view, in partial cross-section, of the mounting bracket shown in FIG. 5.

The mounting bracket 100, as thus far described, is adapted to secure the head rail 158 of a venetian blind between the frame members 160 of a window opening. However, it may be desired that the head rail 158 be mounted across the face of the window opening where the head rail is longer than the corresponding window opening. This requires what is typically called an outside mount. In order to accommodate such an outside mount, another embodiment of the present invention has been devised as shown in FIGS. 5 and 6. In referring to FIGS. 5 and 6, it is to be understood that like reference numerals represent like elements. In fact, the outside mounting bracket 164 is of similar construction and operation to the mounting bracket 100. Thus, only the differences therebetween will be described.

The housing 104 is provided with a lateral extension 166. The lateral extension 166 includes a wall member 168 extending normal to the longitudinal axis of housing 104 and formed as a unitary extension to side wall 116. The wall member 168 is displaced longitudinally from end wall 118 of the housing 104. A pair of web members 170,172 are unitarily formed between the wall member 168 and side wall 116 of the housing 104 to provide mechanical strength to the wall member when under compression. It can be appreciated that the housing 104 and lateral extension 166 may be unitarily formed by injection molding. The outwardly facing surface of the wall member 168 supports a resilient pad 102 for engaging a frame member 160 of a window opening.

The operation of the mounting bracket 164 is similar to the previously described operation of the mounting bracket 100. That is, a mounting bracket 164 is positioned over each free end of a head rail 158 with their respective resilient pads 102 contacting the opposing surfaces of frame members 160 which define the window opening. Upon rotation of the adjusting members 108 within each of the mounting brackets 164, the wall members 168 are urged towards a respective frame member 160 to hold the head rail 158 across the window opening by compression. As shown in FIG. 6, the slats 174 of the venetian blind hang outside the window opening as opposed to within the window oening in accordance with the utilization of the mounting bracket 100 described with respect to FIGS. 1–4.

Referring to FIGS. 7 and 8, there is disclosed another embodiment of a mounting bracket generally designated by reference numeral 176. The mounting bracket 176, like mounting bracket 164, is adapted for supporting a head rail 158 across a window opening defined by a pair of opposing frame members 160. The mounting bracket 176 is constructed of a generally U-shaped housing 178 being closed at one end by end wall 180. The other end of the housing 178 defines a generally rectangular shaped opening 182 adapted to receive one end of head rail 158. Similar to the embodiment of the mounting bracket 164 shown in FIGS. 5 and 6, the mounting bracket 176 includes a lateral extension 166 formed of a wall member 168 supporting a resilient pad 102, and a pair of web members 170,172. The exposed surface of wall member 168 centrally supports a projecting locating boss 184 of generally pyramid shape, the purpose of which will be described hereinafter. As will become apparent, the locating boss 184 may take the form of other shapes than that of a pyramid, for example, cylindrical, rectangular, and the like.

The head rail 158, or other such article, is received within the housing 178 either longitudinally through opening 182 or transversely through the open top formed by the U-shaped construction of the housing. It is contemplated that head rails 158 of different lengths may be employed with the mounting bracket 176. To this end, the inner surface of the opposing vertical side walls forming the housing 178 are each provided with a plurality of opposing vertical grooves 186. The grooves 186 are adapted to receive an adjustment plate 188 which functions as a stop to limit the extent by which the head rail 158 may be received within the housing 178. In this manner, the adjustment plate 188 will be received within those grooves 186 adjacent the end of the head rail 158. Thus, as shown in dotted lines, the adjustment plate 188 will accommodate head rails 158 of varying lengths. To this end, a similar mounting bracket 176 will be positioned at the opposing end of the head rail 158.

Figures 11, 12:
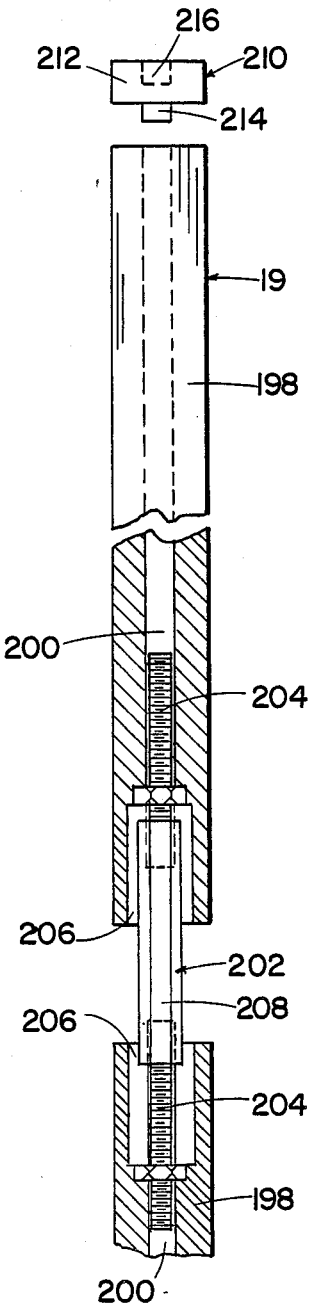
FIG. 11 is a front elevation view, in partial cross-section, of an adjustment member including a turnbuckle as one component of the mounting bracket constructed in accordance with one embodiment of the present invention.
FIG. 12 is a side elevational view of a modular extension spacer provided as an accessory to the mounting bracket constructed in accordance with one embodiment of the present invention.

Unlike mounting brackets 100,164, mounting bracket 176 is held in position by means of an adjustment member 190 as best shown in FIG. 11. The adjustment member 190 is received between the lateral extensions 166 of a pair of opposing mounting brackets 176 to urge their respective wall members 168 against a portion of the opposing frame members 160 which defines the window opening. Briefly, the adjustment member 190 is extensible in a longitudinal direction to supply a sufficient suppressive force against the wall members 168 of the lateral extensions 166 to achieve the supporting function.

Figure 9:
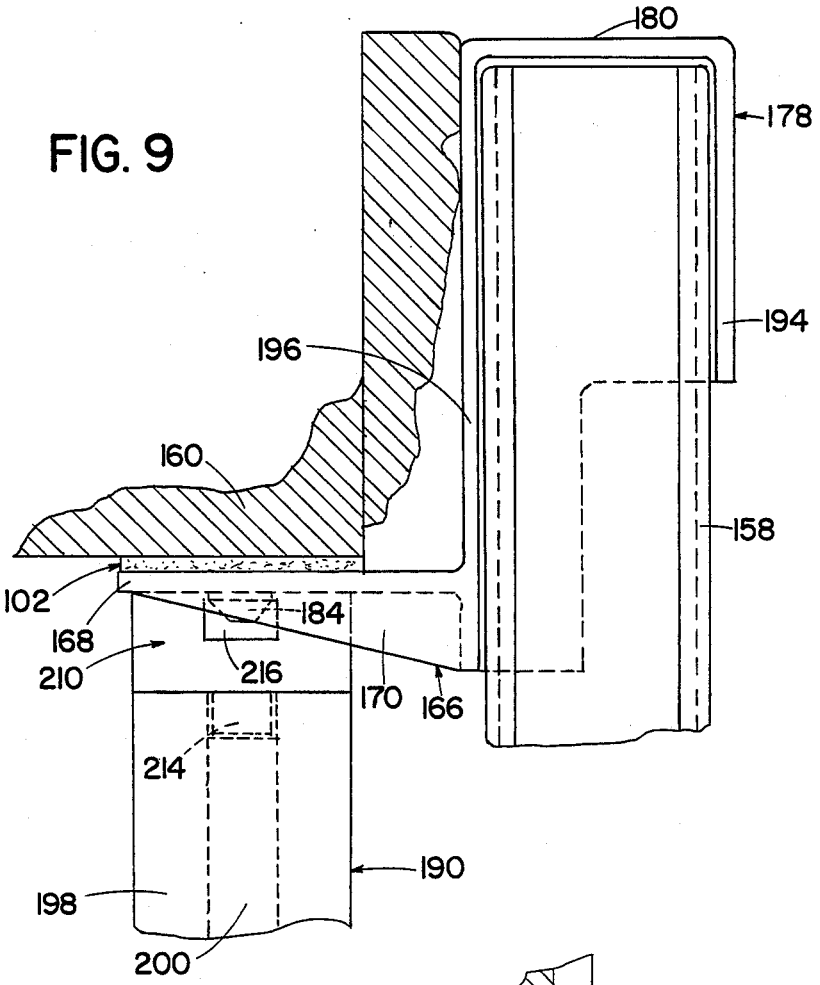
FIG. 9 is a top plan view, in partial cross-section, of a mounting bracket constructed in accordance with another embodiment of the present invention.
Figure 10:
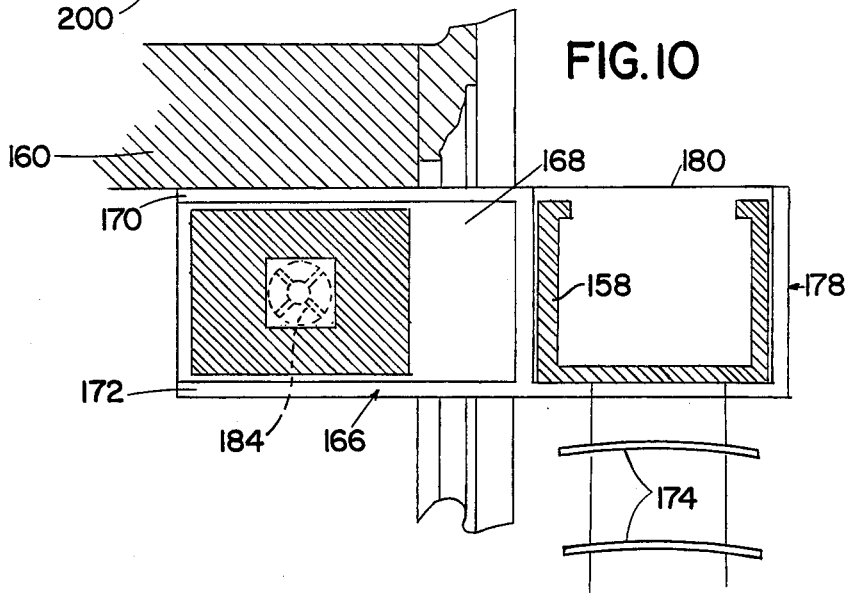
FIG. 10 is a side elevation view, in partial cross-section, of the mounting bracket shown in FIG. 9.

Before providing a detailed description of the adjustment member 190, reference is being made to FIGS. 9 and 10 which disclose another embodiment of a mounting bracket constructed in accordance with the present invention. It will be appreciated that the mounting bracket is substantially similar in overall construction to the mounting bracket 176. Therefore, like elements will have like reference numerals and a description of the common elements will not be provided. In this regard, the housing 178 is substantially larger in longitudinal dimension than the corresponding housing of the mounting bracket 176. The longer housing 178 is adapted to receive a head rail 158 of substantially greater length than that disclosed in FIG. 7 so as to extend further beyond the extent of the window opening. For aesthetic reasons, the front side wall 194 of the housing 178 is substantially shorter than the rear side wall 196. Additionally, it is noted that the side walls 194,196 are not provided with the plurality of grooves 186 and adjustment plate 188 as shown with respect to the mounting bracket 176 in FIG. 7. However, it is contemplated that grooves 186 may be provided to accommodate an adjustment plate 188 if desired. The attachment of the mounting bracket 178 to the inside surface of a window frame 160 will also require utilization of an adjustment member 190 as to be described hereinafter.

The adjustment member 190, as best shown in FIG. 11, is constructed from a pair of longitudinally extending rods 198 each having a central bore 200 extending therethrough. The rods 198 are joined in spaced-apart relationship by means of a turnbuckle 202. The turnbuckle 202 is constructed of a pair of threaded rods 204 respectively secured within the bore 200 of each of the rods 198. A portion of the threaded rod 204 extends through an enlarged opening 206 at one end of each of the rods 198. Received within the enlarged opening 206 and threadably engaging each threaded rod 204 is a turnbuckle expansion member 208. By rotation of the turnbuckle expansion member 208, the longitudinal length of the adjustment member 190 may be varied.

Referring once again to FIGS. 7 and 9, the adjustment member 190 is positioned longitudinally adjacent to the rear side of the head rail 158. As shown, the opposing ends of the adjustment member 190, via rods 198, engage the rear surface of wall member 168 of each lateral extension 166. The position of the adjustment member 190 is maintained by its bore 200 capturing the locating boss 184 projecting from the wall member 168 of each lateral extension 166. By rotation of the turnbuckle expansion member 208, the longitudinal length of the adjustment member 190 will be increased or decreased for installing or removing the head rail 158 or other such article across the expanse of a window opening. In the preferred embodiment, the adjustment member 190 will be secured between a pair of lateral extensions 166 abutting the inside surface of opposing frame members 160 of a window opening. It should be understood that the adjustment member 190 although described as being in the form of a turnbuckle 202, may have other forms, such as being a spring loaded member and the like.

In order to provide the adjustment member 190 with a universal function to accommodate head rails 158 and window openings of various lengths, a plurality of modular extension spacers 210 may be employed. As shown in FIG. 12, the spacer 210 is constructed as a cylindrical member 212 having a similar diameter to that of rod 198. One surface of the cylindrical member 212 supports a projecting boss 214 while the other surface has an opening 216 provided therein. As shown in FIG. 9, the spacer 210 is positioned between one end of rod 198 and the wall member 168 of the lateral extension 166. The spacer 210 is held in position by its boss 214 being received within the bore 200 of rod 198 and its opening 216 capturing the locating boss 184 extending from the wall member 168 of the lateral extension 166. It is to be understood that a plurality of spacers 210 may be employed at either end of the adjustment member 190 to vary its length as desired.

Accordingly, there has thus far been described a variety of mounting brackets adapted for mounting venetian blinds and other such articles within a window frame that can be fitted onto the ends of the head rail of a venetian blind for friction fastening of the head rail within a window casement or frame without screws or nails or other things that would physically change or damage the frame members of the window casement. The venetian blinds or other such articles, by utilization of the disclosed mounting brackets can be very quickly mounted with a minimal amount of skill required by the average home owner or head of household, and can be easily and quickly dismounted for realignment, cleaning or replacement, as necessary.

Although the invention herein has been described with reference to particular embodiments, it is to be understood that these embodiments are merely illustrative of the principles and application of the present invention. It is therefore to be understood that numerous modifications may be made to the embodiments and that other arrangements may be devised without departing from the spirit and scope of the present invention as defined by the appended claims.

What is claimed is:

1. A device for mounting an article across an opening, said device comprising a first mounting bracket including a housing having a first portion constructed to receive one end of said article and a second portion constructed to engage one surface bounding said opening, and an adjustment member rotatably mounted within said housing between said one end of said article and said second portion when said article is received within said first portion, said adjustment member advancing within said housing along an axis thereof towards said one end of said article upon rotation of said adjustment member to urge said second portion of said housing away from said one end of said article and against said one surface bounding said opening to hold said article thereat.

2. The device of claim 1, further including a spacer positioned within said housing between said article and a portion of said adjustment member, said spacer engaging said article upon rotation of said adjustment member.

3. The device of claim 2, wherein said spacer includes an opening through which a portion of said adjustment member is slidingly received whereby rotation of said adjustment member causes said spacer to advance longitudinally within said housing.

4. The device of claim 1, further including a threaded rod secured within said housing about which said adjustment member is rotatably mounted.

5. The device of claim 1, wherein said housing includes an opening whereby a circumferential portion of said adjustment member is accessible from outside of said housing.

6. The device of claim 5, wherein said circumferential portion of said adjustment member includes a plurality of openings for receiving an implement to effect rotation of said adjustment member from outside said housing.

7. The device of claim 6, further including a spacer positioned within said housing between said article and a portion of said adjusting member adjacent said plurality of openings, said spacer engaging said article upon rotation of said adjustment member.

8. The device of claim 6, wherein said plurality of openings are arranged radially within said adjustment member.

9. The device of claim 1, wherein said second portion of said housing comprises a closed end thereof.

10. The device of claim 9, wherein said closed end of said housing is arranged opposing said first portion, said adjustment member rotatably mounted therebetween.

11. The device of claim 1, wherein said second portion comprises a lateral extension of said housing.

12. The device of claim 11, wherein said lateral extension is arranged substantially normal to a longitudinal axis of said housing.

13. The device of claim 12, wherein said housing includes a closed end opposing said first portion, said lateral extension being displaced longitudinally along said longitudinal axis of said housing with respect to said closed end thereof.

14. The device of claim 1, wherein said article comprises a venetian blind.

15. The device of claim 1, further including a second mounting bracket constructed in accordance with said first mounting bracket, said second mounting bracket receiving another end of said article and having a second portion thereof urged against another surface bounding said opening to hold said article thereat.

16. A device for mounting an article across an opening, said device comprising a first mounting bracket including a housing having a first portion constructed to receive one end of said article and a second portion constructed to engage one surface bounding said opening, and an adjustment mechanism arranged within said housing, said adjustment mechanism including a stationary member and a rotatable member, said rotatable member arranged between said one end of said article when received within said housing and said second portion thereof, said rotatable member advancing within said housing along an axis thereof towards said one end of said article upon rotation of said rotatable member to urge said second portion of said housing away from said one end of said article and against one surface bounding said opening to hold said article thereat.

17. A device for mounting an article across an opening, said device comprising a first mounting bracket including a housing having a first portion constructed to receive one end of said article and a second portion constructed to engage one surface bounding said opening, and an adjustment mechanism arranged within said housing, said adjustment mechanism including (i) a threaded non-rotatable member secured to said second portion and (ii) a rotatable member threadingly received about said non-rotatable member and arranged between said one end of said article when received within said housing and said second portion thereof, said rotatable member advancing within said housing along said non-rotatable member towards said one end of said article upon rotation of said rotatable member to urge said second portion of said housing away from said one end of said article and against one surface bounding said opening to hold said article thereat.

* * * * *

UNITED STATES PATENT AND TRADEMARK OFFICE

CERTIFICATE OF CORRECTION

PATENT NO. : 4,848,432

DATED : July 18, 1989

INVENTOR(S) : Connolly

It is certified that error appears in the above-identified patent and that said Letters Patent is hereby corrected as shown below:

Column 3, briding lines 57 and 58, "references" should read --reference--.

Signed and Sealed this

Tenth Day of July, 1990

*Attest:*

HARRY F. MANBECK, JR.

*Attesting Officer*

*Commissioner of Patents and Trademarks*